US011739596B2

(12) United States Patent
Maher

(10) Patent No.: US 11,739,596 B2
(45) Date of Patent: Aug. 29, 2023

(54) ENGINEERED WEAK POINT FOR RISER SYSTEMS

(71) Applicant: Trendsetter Vulcan Offshore, Inc., Houston, TX (US)

(72) Inventor: James V. Maher, Houston, TX (US)

(73) Assignee: TRENDSETTER VULCAN OFFSHORE, INC., Houston, TX (US)

( * ) Notice: Subject to any disclaimer, the term of this patent is extended or adjusted under 35 U.S.C. 154(b) by 0 days.

(21) Appl. No.: 17/900,171

(22) Filed: Aug. 31, 2022

(65) Prior Publication Data

US 2023/0062766 A1 Mar. 2, 2023

Related U.S. Application Data

(60) Provisional application No. 63/239,225, filed on Aug. 31, 2021.

(51) Int. Cl.

| | |
|---|---|
| ***E21B 17/08*** | (2006.01) |
| ***F16L 35/00*** | (2006.01) |
| ***E21B 17/01*** | (2006.01) |
| ***E21B 17/06*** | (2006.01) |
| ***B23P 11/00*** | (2006.01) |

(52) U.S. Cl.
CPC ..... *E21B 17/085* (2013.01)

(58) Field of Classification Search
None
See application file for complete search history.

(56) References Cited

U.S. PATENT DOCUMENTS

| | | | | |
|---|---|---|---|---|
| 4,059,288 | A | 11/1977 | Mohr | |
| 4,348,039 | A | 9/1982 | Miller | |
| 4,424,988 | A | 1/1984 | Cowx | |
| 4,880,257 | A * | 11/1989 | Holbert, Jr. | E21B 17/06 285/900 |
| 5,161,828 | A * | 11/1992 | Hynes | E21B 43/013 166/347 |
| 5,382,056 | A | 1/1995 | Milberger | |
| 6,315,497 | B1 * | 11/2001 | Wittman | H05B 3/06 138/33 |
| 8,555,981 | B2 | 10/2013 | Edwards et al. | |
| 9,169,699 | B2 * | 10/2015 | Rytlewski | E21B 17/06 |
| 9,322,225 | B2 | 4/2016 | Mogedal et al. | |
| 9,334,697 | B2 | 5/2016 | Reinas et al. | |
| 9,353,602 | B2 | 5/2016 | Kongshem | |
| 2016/0076313 | A1 * | 3/2016 | Luo | E21B 17/015 166/367 |

* cited by examiner

*Primary Examiner* — Matthew Troutman
*Assistant Examiner* — Douglas S Wood
(74) *Attorney, Agent, or Firm* — Jonathan Pierce; Pierre Campanac; Porter Hedges LLP

(57) ABSTRACT

A joint assembly allows a riser system to have a weak point that can fail at a known location and tension value without reducing the riser pressure containment capacity. The joint assembly includes a standard riser pipe machined to remove material, for example, to form a groove. The joint assembly also comprises means for restoring pressure capacity. For example, the means for restoring pressure capacity include a combination of a thick-bodied clamp and a split insert ring. The split insert ring can bridge between the groove and the clamp, at least partially transferring the pressure load contained inside the machined pipe to the clamp.

15 Claims, 3 Drawing Sheets

ENGINEERED WEAK POINT FOR RISER SYSTEMS

CROSS-REFERENCE TO RELATED APPLICATIONS

This application claims the benefit of priority to U.S. provisional application Ser. No. 63/239,225 filed on Aug. 31, 2021, which is incorporated herein by reference for all and any purposes.

BACKGROUND

This disclosure relates generally to a joint assembly for providing a weak point in a marine, completion, or intervention riser that allows the riser to sever at a predetermined longitudinal tension rating, a method of using such a joint assembly, and a method of making such a joint assembly. This disclosure relates more particularly to a joint assembly where the weak point can be provided by machining material out of a unitary pipe joint, and a pressure capacity of the unitary pipe joint is restored using a means that at least partially surrounds and contacts a perimeter of the unitary pipe joint where the material is machined out.

It is often advisable to include a weak point in a riser provided between a wellhead located on the seafloor and a platform or vessel located at the sea surface. In cases of emergency, the weak point allows severing the riser without damaging the wellhead and/or the well completion connected below the wellhead.

In several known weak points, a joint is placed between standard pipes. The joint has a complex design involving several parts and/or added seals. Examples of such weak points can be found, for example, in U.S. Pat. Nos. 4,059,288, 4,348,039, 4,424,988, 4,880,257, 5,382,056, 8,555,981, 9,322,225, 9,334,697, and 9,353,602.

Despite these advances, there is a need in the art for a joint assembly that provides a weak point that allows a riser to sever at a predetermined longitudinal tension rating without reducing a predetermined pressure containment rating of the riser. Preferably, the joint assembly has a simple design with few parts and/or does not require an added seal.

BRIEF SUMMARY OF THE DISCLOSURE

The disclosure describes a joint assembly used for providing a weak point. The weak point may allow a riser having a longitudinal axis to sever at a predetermined longitudinal tension rating. The weak point may be provided without reducing a predetermined pressure containment rating of the riser.

The joint assembly may comprise an upper body, a middle body, and a lower body. The middle body may connect the pipe of the upper body to the pipe of the lower body. The upper body may include a pipe. The pipe may have a first longitudinal tension rating that is larger than the predetermined longitudinal tension rating. The middle body may have a second longitudinal tension rating that is equal to the predetermined longitudinal tension rating and a pressure containment rating that is smaller than the predetermined pressure containment rating. The lower body may include a pipe that has a third longitudinal tension rating that is larger than the predetermined longitudinal tension rating. In some embodiments, the upper body, the middle body, and the lower body may form a unitary pipe, and the middle body may include a groove forming a closed loop around a perimeter of the middle body or perforations distributed around the perimeter of the middle body. For example, the groove or the perforations may be formed by removing or machining out the material of a cylindrical pipe.

The joint assembly may also comprise means for restoring pressure capacity. When the means for restoring pressure capacity at least partially surrounds and contacts the perimeter of the middle body, a sub-assembly including the middle body and the means for restoring pressure capacity may have a fourth longitudinal tension rating that is equal to the predetermined longitudinal tension rating and a pressure containment rating that is equal to or larger than the predetermined pressure containment rating.

As used herein, the means for restoring pressure capacity is generally sized to at least partially surround and contact the perimeter of the middle body. The means for restoring pressure capacity may include a clamp, brace, band, clasp, or an equivalent thereof, that can be wrapped around the middle body. The means for restoring pressure capacity may also include one or more fasteners, such as studs or bolts and associated nuts, or an equivalent thereof, that allow applying the clamp, brace, band, or clasp on at least a portion of the perimeter of the middle body. Optionally, the means for restoring pressure capacity may include one or more inserts that are detached from the clamp, brace, band, clasp, or an equivalent thereof and configured to bridge a gap between the perimeter of the middle body and the clamp, brace, band, clasp, or an equivalent thereof. For example, the one or more inserts may include ring segments.

Preferably, the means for restoring pressure capacity is shaped to not hinder relative longitudinal movement of at least one of the upper body or the lower body. For example, the means for restoring pressure capacity may be, in use, entirely offset from at least one of the upper body or the lower body. Alternatively, the means for restoring pressure capacity may include one or more pads, skids, or an equivalent thereof, having a low shear modulus. For example, the pad or skids may be made of a preloaded elastomer. Yet alternatively, the means for restoring pressure capacity may be, in use, in contact with the upper body or the lower body only over at most a minority portion (i.e., less than 50%, or even less than 25%) of the longitudinal overlap between the upper body or the lower body and the means for restoring pressure capacity. The contact area between the means for restoring pressure capacity and the upper body or the lower body may be configured to prevent or minimize compression hotspots. In addition, the friction coefficient between the upper body or the lower body and the means for restoring pressure capacity may be small (e.g., less than 0.3, or even less than 0.1).

Preferably, the means for restoring pressure capacity is more rigid (e.g., at least twice more rigid, or even three times more rigid) in flexion than the middle body. For example, the means for restoring pressure capacity may be sized to transmit a bending moment between the upper body and the lower body, thereby reducing the flexion of the middle body under the bending moment.

Preferably, the means for restoring pressure capacity does not include a seal.

In use, applying the predetermined longitudinal tension or a higher tension to the riser may cause the middle body to sever.

BRIEF DESCRIPTION OF THE DRAWINGS

For a more detailed description of the embodiments of the disclosure, reference can now be made to the accompanying drawings, wherein.

DETAILED DESCRIPTION

The joint assembly described in the disclosure can solve the problem of allowing a riser system to have a weak point that can fail at a known location and tension value without reducing the riser pressure containment capacity. This joint assembly may be made using a standard riser pipe without the need to have a seal be part of the joint assembly, although a seal can also be provided.

The standard riser pipe can be machined to remove material (e.g., to form a groove) either on the Outside Diameter only or on both the Outside and Inside Diameters. The advantage of removing material on the OD only is that the required machining operations can be simpler than removing material on both the ID and OD, but a disadvantage can be that an amount of local bending should be expected due to tension. Machining both the Inside and Outside Diameters can reduce or eliminate the local bending.

By machining down the effective wall thickness of the standard riser pipe, the point at which the machined pipe fails in tension is reduced to the desired tension capacity. As an example, a riser pipe that would otherwise fail at a rating of 2.0 MM lbs can be downrated to 1.0 MM lbs by machining out approximately half of the wall thickness (or, more precisely, half of the cross-section). This machining operation, however, can reduce the pressure capacity of the machined riser pipe to an unacceptably low value.

Figure 1:
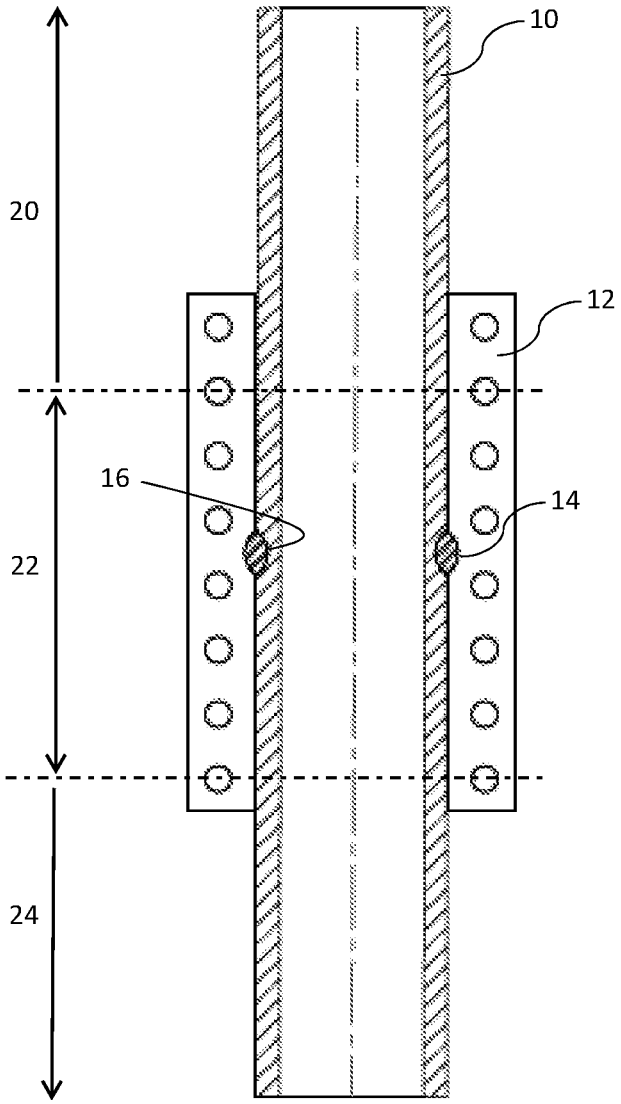
FIG. 1 is a sectional view of an example joint assembly.
Figure 2:
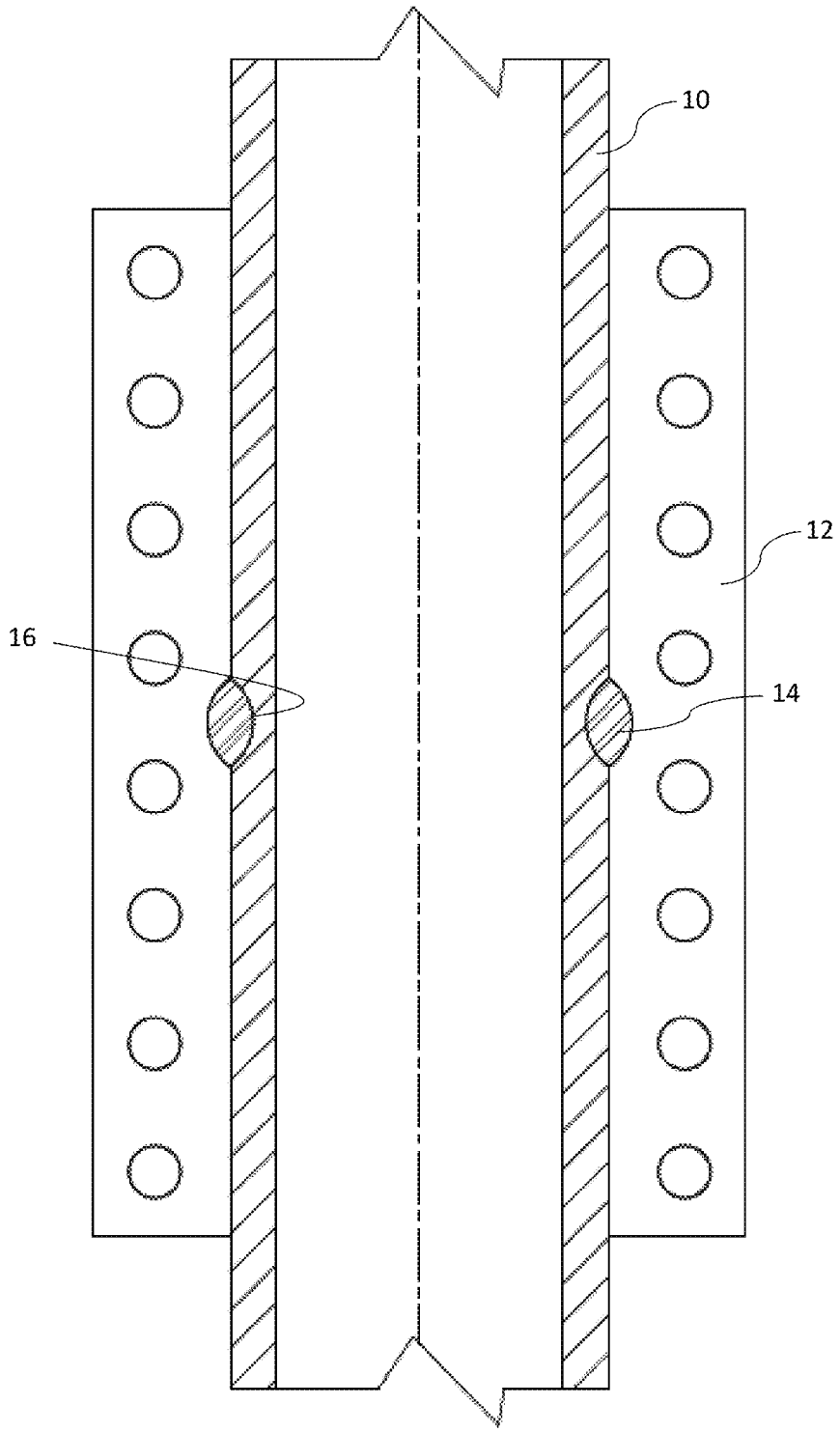
FIG. 2 is a sectional view of a portion of the joint assembly shown in FIG. 1.
Figure 3:
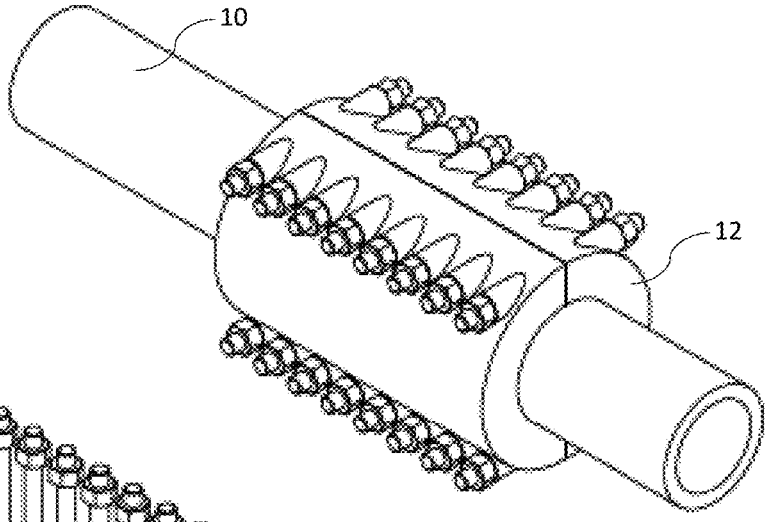
FIG. 3 is a perspective view side view of the joint assembly shown in FIG. 1.
Figure 4:
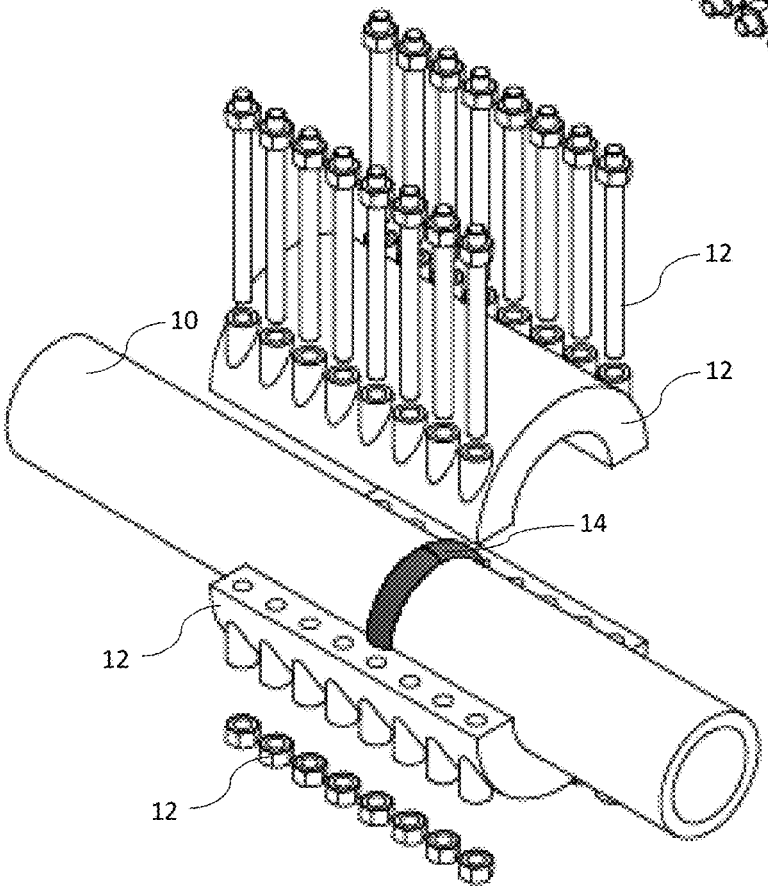
FIG. 4 is an exploded view of the joint assembly shown in FIG. 1.

Referring to FIG. 1, a standard riser pipe is machined to form the machined riser pipe 10. The machined riser pipe 10 comprises an upper body 20, a middle body 22, and a lower body 24. The middle body 22 connects the upper body 22 to the lower body 24.

Referring to FIGS. 1-4, the pressure capacity can then be restored to its intended value by adding a thick-bodied clamp 12 to the outside of the machined riser pipe 10, with a split insert ring 14 that is designed to interface directly with the machined profile 16 (e.g., a groove) and the ID of the clamp 12. The split insert ring 14 can bridge between the machined profile 16 and the clamp 12, partially transferring the pressure load contained inside the machined pipe 10 to the body and bolts of the clamp 12. The split insert ring 14 may be formed by ring segments that are stacked radially and/or along the machined riser pipe 10. The split insert ring 14 preferably surrounds the entire length of profile 16 or a substantial portion of the height of profile 16. Alternatively, segments similar to the ring segments of the split insert ring 14 are integral to (e.g., braised to) the thick-bodied clamp 12.

This combination of thick-bodied clamp 12 and split insert ring 14 can be used to make a joint assembly that has a pressure capacity greater than or equal to the original, standard riser pipe but a tension capacity that is as low as the riser designer would like it to be in order to suit the weak point requirements of the riser system.

Alternatively, the standard riser pipe could be machined to remove material across or through the wall thickness (e.g., form perforations) that are then filled by ring segments that seal the perforations. Other known ways of reducing tension capacity can also be used.

By making the body of clamp 12 long enough, the machined profile 16 can also be isolated from bending stresses. The ends of the body of clamp 12 are preferably profiled in order to reduce any compression hotspots that are due to the bending. In some embodiments, it may be advantageous to also introduce a preloaded elastomer (not shown) between each of the two ends and the machined riser pipe 10, which can allow a smooth stiffness transition and thereby reduce any hotspots.

The disclosure is susceptible to various modifications and alternative forms. Specific embodiments thereof are shown by way of examples in the drawings and description. It should be understood, however, that the drawings and detailed description thereto are not intended to limit the scope of the invention to the particular form disclosed. However, on the contrary, the intention is to cover all modifications, equivalents, and alternatives enabled by the disclosure.

What is claimed is:

1. A joint assembly for providing a weak point that allows a riser having a longitudinal axis to sever at a predetermined longitudinal tension rating without reducing a predetermined pressure containment rating of the riser, comprising:

an upper body including a pipe, the pipe having a first longitudinal tension rating that is larger than the predetermined longitudinal tension rating;

a middle body, the middle body having a second longitudinal tension rating that is equal to the predetermined longitudinal tension rating and a pressure containment rating that is smaller than the predetermined pressure containment rating;

a lower body including a pipe, the pipe having a third longitudinal tension rating that is larger than the predetermined longitudinal tension rating; and means for restoring pressure capacity;

wherein the middle body connects the pipe of the upper body to the pipe of the lower body;

wherein the means for restoring pressure capacity is sized to at least partially surround and contact a perimeter of the middle body;

wherein the means for restoring pressure capacity is more rigid in flexion than the middle body; and wherein a sub-assembly including the middle body and the means for restoring pressure capacity surrounding and contacting the middle body has a fourth longitudinal tension rating that is equal to the predetermined longitudinal tension rating and a pressure containment rating that is equal to or larger than the predetermined pressure containment rating.

2. The joint assembly of claim 1 wherein the means for restoring pressure capacity is shaped to not hinder relative longitudinal movement of at least one of the upper body or the lower body.

3. The joint assembly of claim 1 wherein the means for restoring pressure capacity does not include a seal.

4. The joint assembly of claim 1 wherein the upper body, the middle body, and the lower body form a unitary pipe, and wherein the middle body includes a groove forming a closed loop around the perimeter of the middle body or perforations distributed around the perimeter of the middle body.

5. The joint assembly of claim 4 wherein the middle body includes an outer groove.

6. A method of using a joint assembly, comprising:

providing a joint assembly having a weak point that a riser to sever at a predetermined longitudinal tension rating without reducing a predetermined pressure containment rating of the riser, wherein the joint assembly comprises:

an upper body including a pipe, the pipe having a first longitudinal tension rating that is larger than the predetermined longitudinal tension rating;

a middle body, the middle body having a second longitudinal tension rating that is equal to the predetermined longitudinal tension rating and a pressure containment rating that is smaller than the predetermined pressure containment rating;

a lower body including a pipe, the pipe having a third longitudinal tension rating that is larger than the predetermined longitudinal tension rating; and means for restoring pressure capacity;

wherein the middle body connects the pipe of the upper body to the pipe of the lower body;

wherein the means for restoring pressure capacity is sized to at least partially surround and contact a perimeter of the middle body;

wherein the means for restoring pressure capacity is more rigid in flexion than the middle body; and wherein a sub-assembly including the middle body and the means for restoring pressure capacity surrounding and contacting the middle body has a fourth longitudinal tension rating that is equal to the predetermined longitudinal tension rating and a pressure containment rating that is equal to or larger than the predetermined pressure containment rating;

incorporating the joint assembly into the riser; and applying the predetermined longitudinal tension to the riser to cause the middle body to sever.

7. The method of claim 6 wherein the means for restoring pressure capacity is shaped to not hinder relative longitudinal movement of at least one of the upper body or the lower body.

8. The method of claim 7 wherein the means for restoring pressure capacity does not include a seal.

9. The method of claim 6 wherein the upper body, the middle body, and the lower body form a unitary pipe, and wherein the middle body includes a groove forming a closed loop around the perimeter of the middle body or perforations distributed around the perimeter of the middle body, the method further comprising severing the groove or perforation.

10. The method of claim 9 wherein the middle body includes an outer groove.

11. A method of making a joint assembly, comprising:

providing an upper body including a pipe, the pipe having a first longitudinal tension rating that is larger than a predetermined longitudinal tension rating;

providing a middle body, the middle body having a second longitudinal tension rating that is equal to the predetermined longitudinal tension rating and a pressure containment rating that is smaller than a predetermined pressure containment rating;

providing a lower body including a pipe, the pipe having a third longitudinal tension rating that is larger than the predetermined longitudinal tension rating;

wherein the middle body connects the pipe of the upper body to the pipe of the lower body;

providing means for restoring pressure capacity;

wherein the means for restoring pressure capacity is more rigid in flexion than the middle body;

wherein a sub-assembly including the middle body and the means for restoring pressure capacity surrounding and contacting the middle body has a fourth longitudinal tension rating that is equal to the predetermined longitudinal tension rating and a pressure containment rating that is equal to or larger than the predetermined pressure containment rating; and forming a joint assembly having a weak point that allows a riser to sever at the predetermined longitudinal tension rating without reducing the predetermined pressure containment rating of the riser by at least partially surrounding and contacting a perimeter of the middle body with the means for restoring pressure capacity.

12. The method of claim 11 wherein the means for restoring pressure capacity is shaped to not hinder relative longitudinal movement of at least one of the upper body or the lower body.

13. The method of claim 11 wherein the means for restoring pressure capacity does not include a seal.

14. The method of claim 11 wherein the upper body, the middle body, and the lower body form a unitary pipe, and wherein the middle body includes a groove forming a closed loop around the perimeter of the middle body or perforations distributed around the perimeter of the middle body, the method further comprising forming the groove or the perforations by removing material of a cylindrical pipe.

15. The method of claim 14 wherein the middle body includes an outer groove.

* * * * *